US011654406B2

(12) United States Patent
Gros et al.

(10) Patent No.: US 11,654,406 B2
(45) Date of Patent: May 23, 2023

(54) MIXING SYSTEM FOR PRODUCING A COSMETIC PRODUCT AND COSMETIC CAPSULE

(71) Applicant: B2B COSMETICS, La Seyne sur Mer (FR)

(72) Inventors: Julien Gros, Toulon (FR); Grégoire Tutenuit, Toulon (FR)

(73) Assignee: B2B COSMETICS, La Seyne sur Mer (FR)

( * ) Notice: Subject to any disclaimer, the term of this patent is extended or adjusted under 35 U.S.C. 154(b) by 705 days.

(21) Appl. No.: 16/343,619

(22) PCT Filed: Oct. 18, 2017

(86) PCT No.: PCT/FR2017/052872
§ 371 (c)(1),
(2) Date: Apr. 19, 2019

(87) PCT Pub. No.: WO2018/073541
PCT Pub. Date: Apr. 26, 2018

(65) Prior Publication Data

US 2021/0370248 A1 Dec. 2, 2021

(30) Foreign Application Priority Data

Oct. 21, 2016 (FR) ..... 16 60 218

(51) Int. Cl.
*B01F 7/16* (2006.01)
*A45D 34/00* (2006.01)
(Continued)

(52) U.S. Cl.
CPC ..... *B01F 27/808* (2022.01); *A45D 34/00* (2013.01); *B01F 23/41* (2022.01); *B01F 23/43* (2022.01);
(Continued)

(58) Field of Classification Search
CPC ..... A45D 34/00; A45D 2034/002; A45D 2034/005; A45D 2200/056;
(Continued)

(56) References Cited

U.S. PATENT DOCUMENTS

2010/0024361 A1* 2/2010 Ebeling ..... G06Q 10/083 53/443
2012/0031926 A1* 2/2012 Bertoli ..... B01F 13/1058 222/144
(Continued)

FOREIGN PATENT DOCUMENTS

CN 101543741 A * 9/2009
CN 101543741 A 9/2009
(Continued)

OTHER PUBLICATIONS

Yismolis Ral Waddell, Translated Patent Application of CN101543741A (Year: 2009).*
(Continued)

*Primary Examiner* — Elizabeth Insler
(74) *Attorney, Agent, or Firm* — Cantor Colburn LLP

(57) ABSTRACT

The invention relates to a mixing system for producing a cosmetic product. The invention also relates to a capsule (7, 8) containing a cosmetic compound. The mixing system allows the production of a cosmetic product from capsules (7, 8) comprising the raw materials required for the composition of such a cosmetic product, that is the cosmetic texturising agent, the cosmetic active substance and, as required, a cosmetic perfume. The invention is applicable in the cosmetic industry.

13 Claims, 6 Drawing Sheets

(51) Int. Cl.

| | |
|---|---|
| ***B01F 7/24*** | (2006.01) |
| ***B01F 15/02*** | (2006.01) |
| ***B01F 15/06*** | (2006.01) |
| ***B01F 3/08*** | (2006.01) |
| ***B01F 27/808*** | (2022.01) |
| ***B01F 23/41*** | (2022.01) |
| ***B01F 23/43*** | (2022.01) |
| ***B01F 27/921*** | (2022.01) |
| ***B01F 35/92*** | (2022.01) |
| ***B01F 35/221*** | (2022.01) |
| ***B01F 35/71*** | (2022.01) |
| ***B01F 35/21*** | (2022.01) |
| *B01F 35/90* | (2022.01) |
| *B01F 101/21* | (2022.01) |

(52) U.S. Cl.

CPC ..... *B01F 27/921* (2022.01); *B01F 35/21112* (2022.01); *B01F 35/2217* (2022.01); *B01F 35/7131* (2022.01); *B01F 35/71805* (2022.01); *B01F 35/92* (2022.01); *A45D 2034/005* (2013.01); *A45D 2200/056* (2013.01); *A45D 2200/058* (2013.01); *A45D 2200/155* (2013.01); *B01F 2035/98* (2022.01); *B01F 2035/99* (2022.01); *B01F 2101/21* (2022.01)

(58) Field of Classification Search

CPC ..... A45D 2200/058; A45D 2200/155; B01F 3/0807; B01F 3/0853; B01F 7/22; B01F 7/162; B01F 7/242; B01F 15/00149; B01F 15/00422; B01F 15/0206; B01F 15/026; B01F 15/065; B01F 2015/061; B01F 2015/062; B01F 2215/0031; B01F 27/808

USPC ..... 221/93; 222/129, 216, 256, 520; 366/151.2, 162.2, 177.1, 181.4, 182.3, 366/193, 205, 210

See application file for complete search history.

(56) References Cited

U.S. PATENT DOCUMENTS

| | | | | |
|---|---|---|---|---|
| 2012/0241045 | A1* | 9/2012 | Aouad | G01N 35/00584 141/83 |
| 2013/0064034 | A1* | 3/2013 | Almblad | A23G 9/30 366/205 |
| 2013/0287913 | A1* | 10/2013 | Dille | A47J 43/046 426/416 |
| 2015/0157165 | A1* | 6/2015 | Talon | B65D 85/8046 206/0.5 |
| 2016/0051029 | A1* | 2/2016 | Lee | A61Q 19/00 53/51 |
| 2016/0143416 | A1* | 5/2016 | Dourlens | A45D 34/00 53/440 |
| 2018/0008946 | A1* | 1/2018 | Macedo | B01F 13/1055 |
| 2018/0200684 | A1* | 7/2018 | Piastre | B01F 13/0818 |
| 2018/0361334 | A1* | 12/2018 | Bahabri | B01F 33/841 |
| 2020/0315319 | A1* | 10/2020 | Samain | A61K 8/19 |

FOREIGN PATENT DOCUMENTS

| | | | | |
|---|---|---|---|---|
| CN | 104507827 | A | 4/2015 | |
| DE | 84198842 | | 12/1985 | |
| DE | 102006029345 | A1 | 12/2007 | |
| EP | 1093842 | A1 | 4/2001 | |
| FR | 2998193 | A1 | 5/2014 | |
| FR | 3026622 | A1 | 4/2016 | |
| FR | 3027786 | A1 | 5/2016 | |
| KR | 20140140335 | | 12/2014 | |
| WO | 9948802 | A1 | 9/1999 | |
| WO | 2008006553 | A2 | 1/2008 | |
| WO | 2013171621 | A1 | 11/2013 | |
| WO | 2015004259 | A1 | 1/2015 | |
| WO | WO-2016066952 | A1 * | 5/2016 | A45D 19/005 |

OTHER PUBLICATIONS

International Search Report for corresponding application PCT/FR2017/052872 filed Oct. 18, 2017; dated Dec. 20, 2017.

* cited by examiner

MIXING SYSTEM FOR PRODUCING A COSMETIC PRODUCT AND COSMETIC CAPSULE

TECHNICAL FIELD

The disclosure relates to a mixing system for producing a cosmetic product. The disclosure also relates to a capsule containing a cosmetic compound and intended to be used with the mixing system.

BACKGROUND

In a manner known in itself, cosmetic products, for example hydrating and/or antiwrinkle creams, are in particular made from an oily material forming the oil phase and in particular containing plant oils, butters, emulsifying waxes for cosmetic use, an aqueous phase generally containing pure or floral water, or any agent soluble in water and at least one additive, called active ingredient, giving the cosmetic product the desired efficacy. As an example, this active ingredient may be an antiaging active ingredient such as hyaluronic acid. Furthermore, the cosmetic product may comprise a natural or synthetic perfume, which makes the application and use of the cosmetic product more pleasant.

However, the available cosmetic products in emulsion form do not offer the possibility of freely choosing their composition in terms of oil, active ingredients and perfumes, the oil phase in particular influencing the texture of the cream, its viscosity, its spreading power, its sensation upon application. Furthermore, the consumer cannot always find the desired combination of oil-active ingredient-perfume.

BRIEF SUMMARY

The present disclosure aims to offset the above drawbacks of the prior art.

To achieve this aim, the disclosure relates to a mixing system for manufacturing a cosmetic product comprising:

- A liquid reservoir, in particular for water;
- A liquid pump connected between an outlet of the liquid reservoir and the inlet of a liquid intake pipe;
- A moving plate able to be controlled in rotation about a vertical axis and comprising two compartments suitable for respectively including two capsules, one of which contains a cosmetic texturizing agent and the other of which contains a cosmetic active ingredient and means able to expel, by pressure, the content of each capsule outside its corresponding compartment in which it is housed;
- A mixing device comprising, on the one hand, a container arranged below the controlled moving plate in order to position, above the container, the compartment containing the texturizing agent capsule and the compartment containing the active ingredient capsule in order to receive the texturizing agent and the active ingredient expelled from their respective compartments, the container being in fluid communication with the outlet of the liquid intake pipe to introduce liquid into the container in particular after expulsion of the texturizing agent into the container, and on the other hand, a mixing member housed in the container and able to create, in said container, the cosmetic product from the mixture of liquid, cosmetic texturizing agent and cosmetic active ingredient contained in the container.

According to another particularity, the mixing member is a helix mounted at the bottom of the container on an axle coaxial to the latter, passing through the bottom wall of the container and able to be driven by a motor, in particular electric, mounted in the mixing system.

According to another particularity, the container comprises an opening with a timed valve in its bottom wall to allow the flow of the hot cosmetic product into a bottle for storing the cosmetic product.

According to another particularity, the container is a removable cylindrical tube closed by a bottom wall to allow the storage of the cosmetic product for subsequent use thereof and arranged below the two compartments of the moving plate.

According to another particularity, the moving plate includes a third compartment able to be brought above the container and suitable for including a third capsule containing a cosmetic perfume intended to be included in the composition of the cosmetic product.

According to another particularity, the moving plate comprises a funnel-shaped compartment able to be brought above the container to place the outlet of the liquid intake pipe and the container in fluid communication.

According to another particularity, each capsule comprises a cylindrical wall, a bottom wall with a central orifice closed off by a frangible membrane seal and a piston-forming wall housed in the cylindrical wall with the texturizing agent or the corresponding active ingredient contained between the bottom wall and the piston-forming wall and in that the pressurized expulsion means comprises a rod translatable via a motor, in particular electric, mounted in the mixing system, able to exert pressure on the piston-forming wall of each capsule housed in its compartment of the moving plate causing the piercing of the membrane seal of the bottom wall of the capsule and the forced flow outside the capsule of its contents into the container located below the outlet of the corresponding compartment.

According to another particularity, the rotation of the moving plate is controlled via a motor, in particular electric, mounted in the mixing system, such that the pressurized expulsion means can cause the successive forced flow of the content of each capsule housed in its corresponding compartment of the moving plate.

According to another particularity, the mixing system comprises a hollow cooling liquid circulation block at least partially surrounding the container, and whereof the liquid inlet and outlet of said coolant block are connected to the liquid reservoir by another pump to guarantee the cooling of the mixture contained in the container.

According to another particularity, the liquid reservoir comprises two compartments separated by an inner wall, one of the compartments being connected to the liquid pump of the mixing system and the other compartment being connected to the cooling block via the other pump.

According to another particularity, the mixing system comprises an electrical resistance block interposed between the liquid pump of the mixing system and the liquid intake pipe and intended to heat the liquid, and in that it comprises a heating means arranged in the compartment able to receive the texturizing agent capsule, said heating means surrounding the cosmetic texturizing agent capsule housed in the corresponding compartment in order to melt the texturizing agent contained in the capsule before the pressurized expulsion of the texturizing agent in the container by the pressurized expulsion means.

According to another particularity, the mixing system comprises a solenoid valve arranged in the liquid intake pipe in order to control the circulation of liquid in the container.

According to another particularity, the mixing system comprises a flowmeter connected to the liquid pipe of the mixing system and in that it comprises a control means able, when the moving plate is positioned such that the funnel-shaped compartment places the outlet of the liquid intake pipe and the container in fluid communication, to open the solenoid valve in order to guarantee the circulation for a given time interval of a determined volume of liquid in the container and calculated from data from the flowmeter.

According to another particularity, the mixing member comprises a piston forming the bottom wall of the container and a plurality of radial fins secured to the piston and protruding from the upper face of the piston that is able to be rotated with the fins, when the removable container is mounted on the mixing system, by a toothed crown mounted in a support base of the container coaxially to the latter and the axial teeth of which situated on a same side are coupled to the piston, said toothed crown being able to be rotated by an electric motor of the mixing system.

According to another particularity, the mixing member of the mixing device makes it possible to produce an emulsion from liquid coming from the reservoir, melted cosmetic texturizing agent and cosmetic active ingredient coming from the two compartments of the moving plate, and if applicable cosmetic perfume coming from the third compartment of the moving plate to produce the cosmetic product.

The disclosure also relates to a bottle for storing and dispensing a cosmetic product made using a mixing system as previously described, comprising the container removed from the mixing system and filled with the produced cosmetic product and a head closing the opening of the container opposite the piston and including a pump for dispensing cosmetic product and a trigger able to be actuated manually to dispense a volume of cosmetic product leaving the head upon pressing on the trigger and to create a vacuum in the container causing the movement of the piston in the container toward the head to offset the dispensed volume of cosmetic product.

The disclosure also relates to a cosmetic capsule comprising a cosmetic compound and intended to be used with the mixing system as previously described in order to produce the cosmetic product, the capsule comprising a cylindrical wall, a bottom wall with a central orifice closed off by a frangible membrane seal and a piston-forming wall housed in the cylindrical wall with the cosmetic compound contained between the bottom wall and the piston-forming wall.

According to another particularity, the bottom wall of the capsule and the surface of the piston-forming wall situated opposite the bottom wall of the capsule have substantially frustoconical complementary shapes.

According to another particularity, the bottom wall of the capsule comprises a tubular ring with a circular section protruding coaxially from the orifice of the bottom wall outside the capsule.

According to another particularity, the opening of the cylindrical wall of the capsule situated opposite the orifice of the bottom wall is sealed by a circular and frangible membrane.

The disclosure also relates to a use of a mixing system as previously described with two capsules each as previously described and respectively comprising a cosmetic texturizing agent and a cosmetic active ingredient in order to produce the cosmetic product.

According to another particularity, the mixing system is used with a third capsule containing a cosmetic perfume.

BRIEF DESCRIPTION OF THE DRAWINGS

The disclosure will be better understood, and other aims, features, details and advantages thereof will appear more clearly in the following explanatory description done in reference to the appended drawings provided solely as an example illustrating one embodiment of the disclosure and in which.

DETAILED DESCRIPTION

Figure 1:
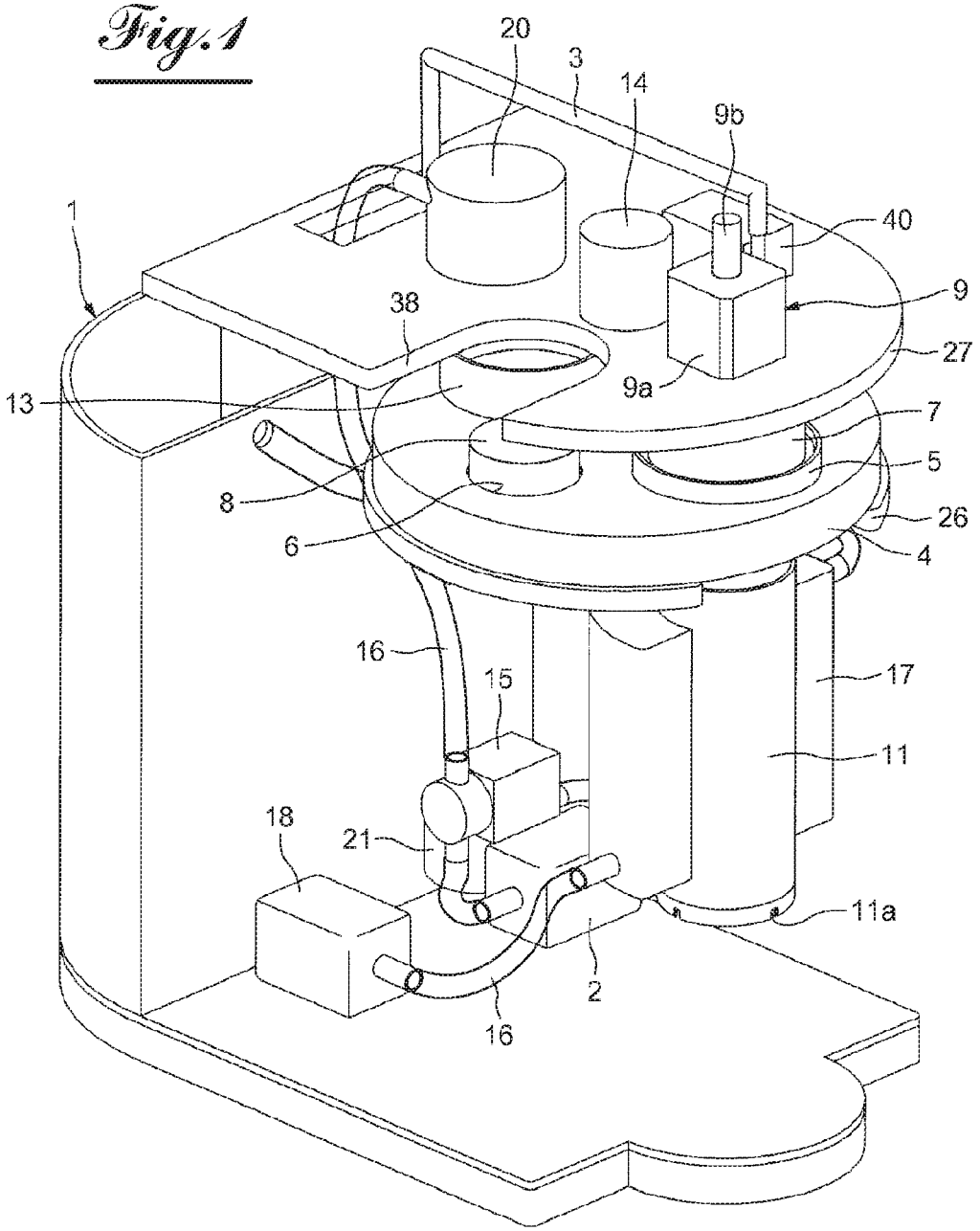
FIG. 1 shows a three-dimensional perspective view of the mixing system according to the disclosure.
Figure 2:
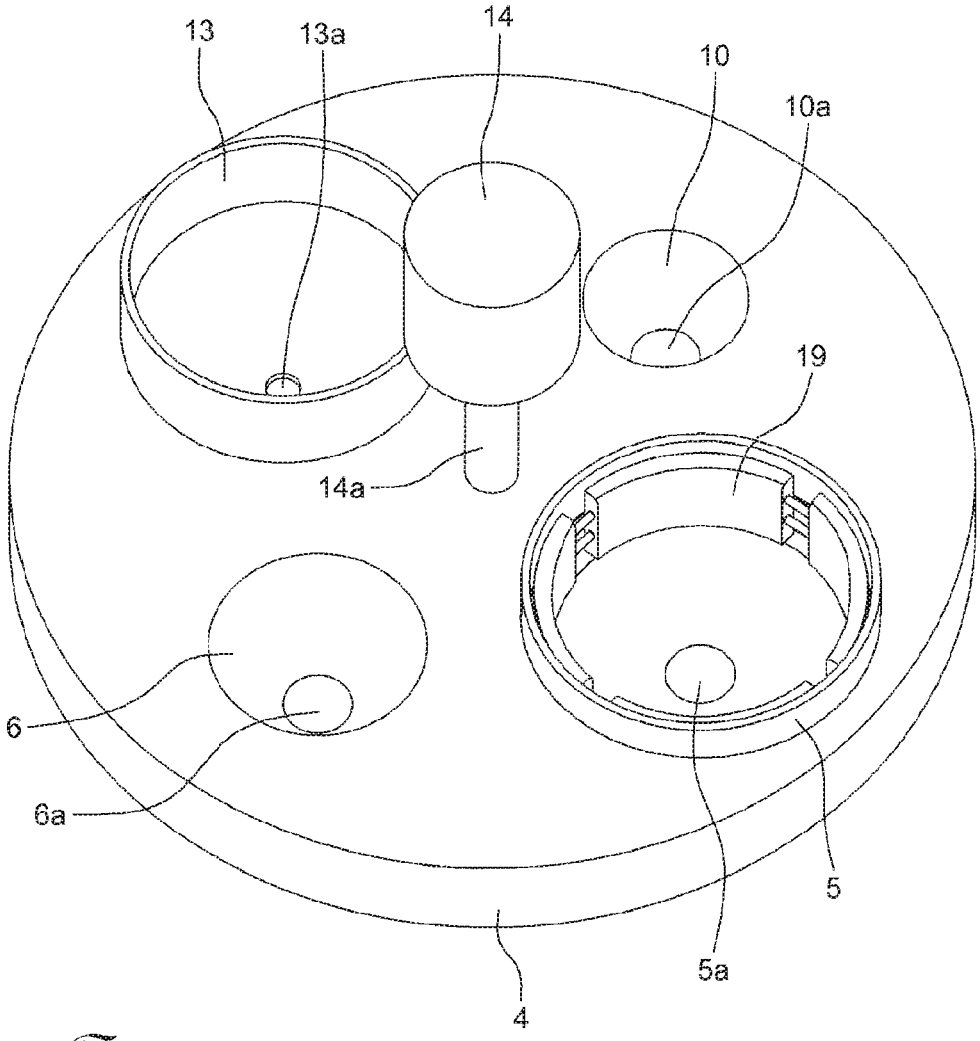
FIG. 2 shows a top perspective view of part of the mixing system of FIG. 1 comprising a mobile plate.
Figure 3:
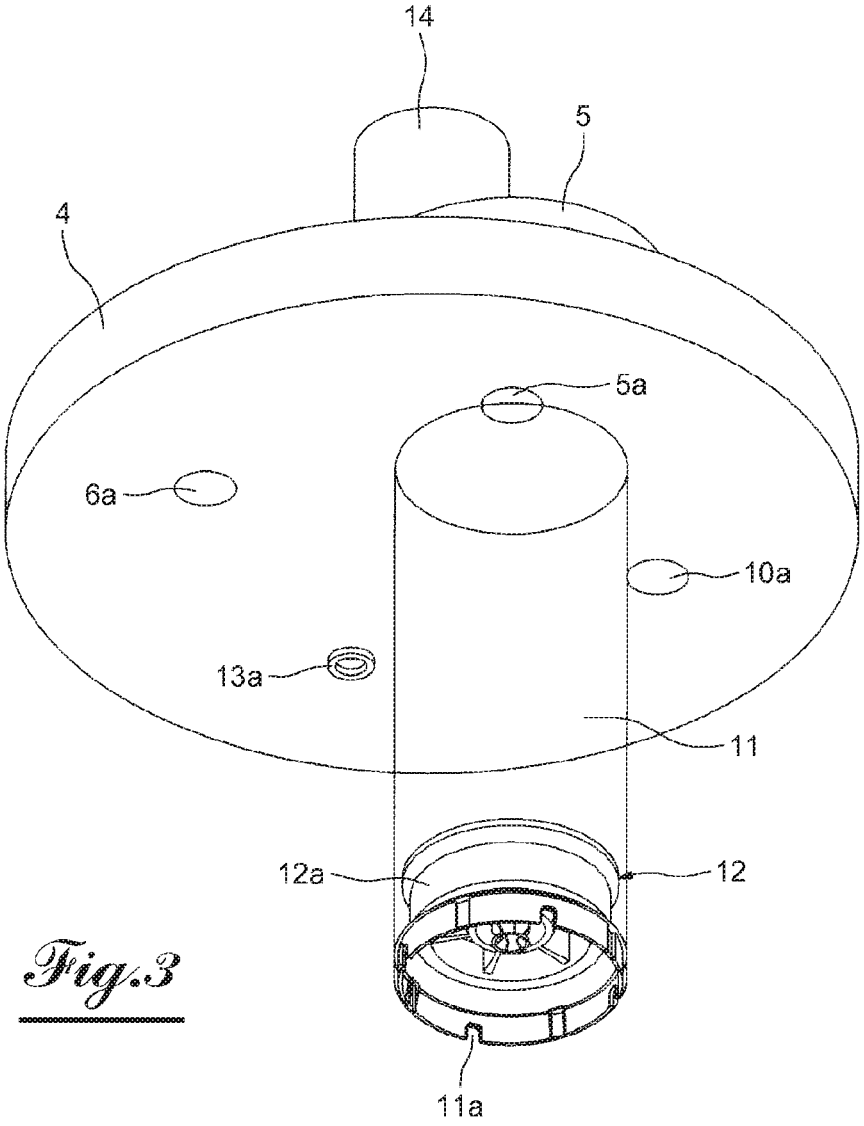
FIG. 3 shows a perspective bottom view of the mobile plate of FIG. 2, an outlet of a compartment of which is in fluid communication with a container of the mixing system of FIG. 1.
Figure 4:
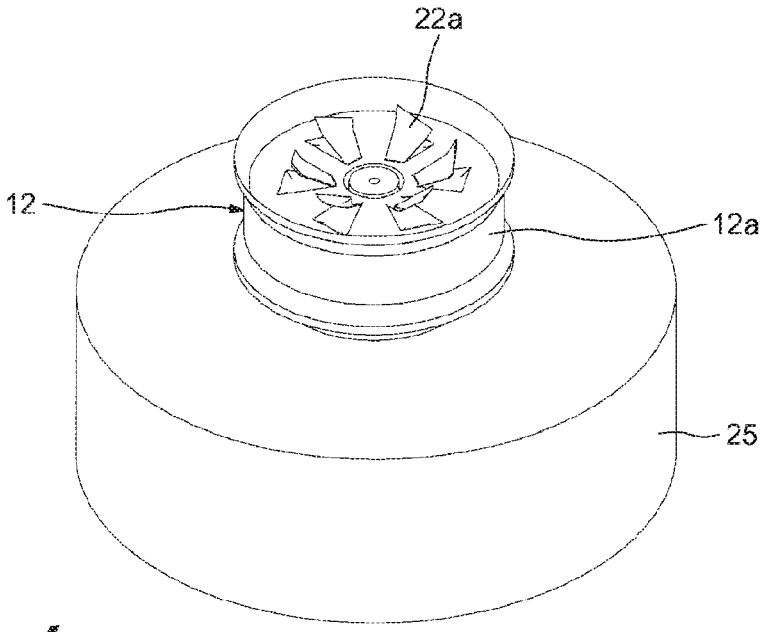
FIG. 4 shows a perspective view of a piston with fins forming the bottom wall of the container of FIG. 3.
Figure 5:
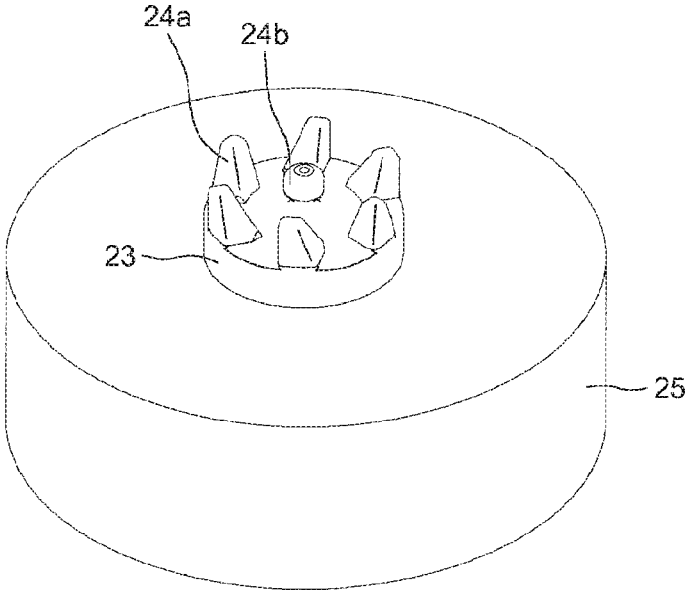
FIG. 5 shows a perspective view of a toothed crown intended to drive the piston of FIG. 4.
Figure 6:
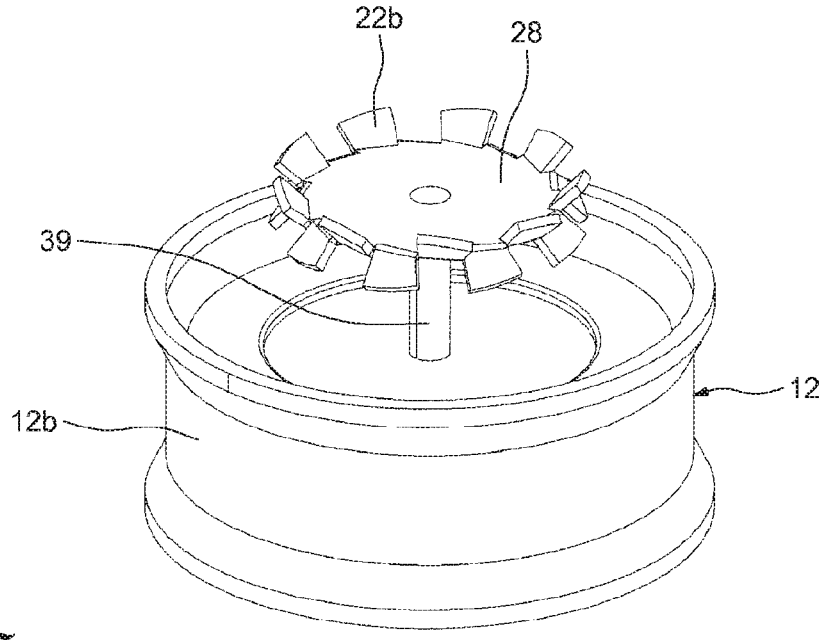
FIG. 6 shows a perspective view of an alternative of the piston with fins of FIG. 4, showing a mixing disc provided with fins.
Figure 7:
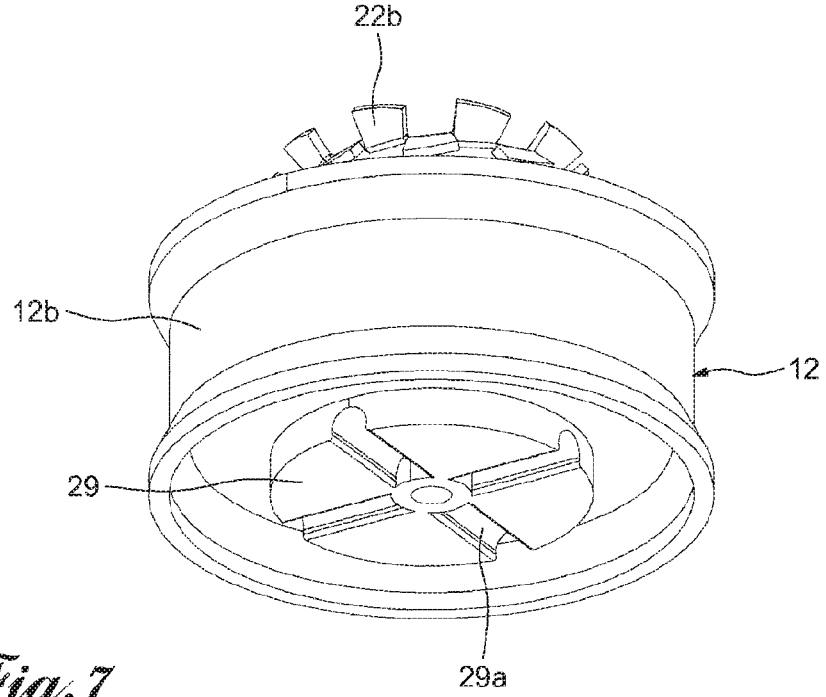
FIG. 7 shows a perspective view of the piston of FIG. 6, showing a disc for driving the mixing disc.
Figure 8:
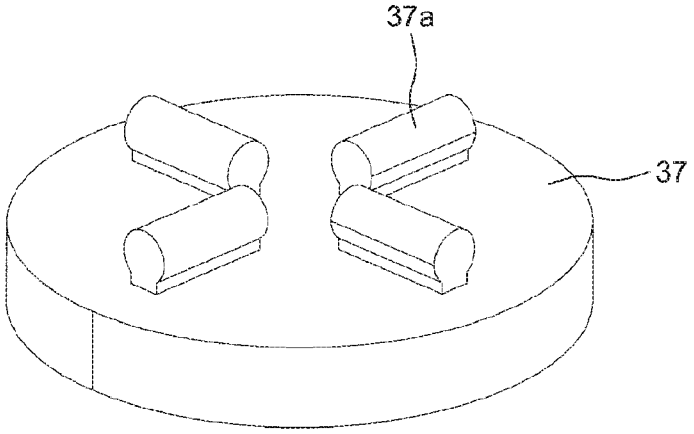
FIG. 8 shows a perspective view of an alternative of the toothed crown intended to drive the piston of FIG. 6.
Figure 9:
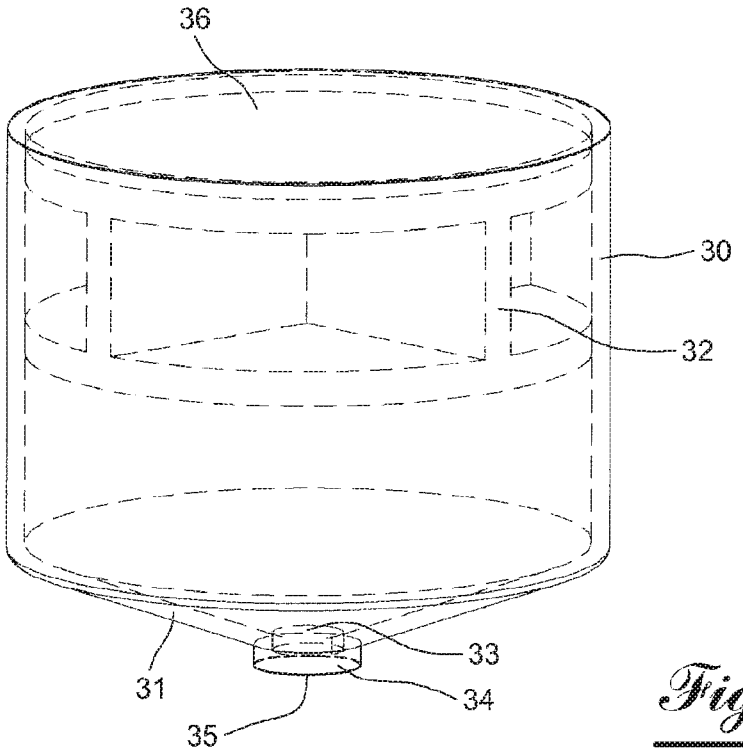
FIG. 9 shows a perspective view of a cosmetic capsule according to the disclosure.

In reference to the figures and according to the disclosure, a mixing system for producing a cosmetic product will now be described.

The mixing system comprises a liquid reservoir 1. This liquid reservoir 1 comprises an inner wall separating the reservoir 1 into a first liquid compartment and a second liquid compartment, the respective functions of which will be specified below. The first liquid compartment comprises the aqueous phase entering the composition of the cosmetic product, and which is preferably demineralized water or floral water (i.e., a hydrolat), but it may also be a more complex aqueous liquid made up of water and additives such as glycerin or a polymer allowing the creation of a three-dimensional network. The second liquid compartment in turn comprises pure or demineralized water, or simply tap water. In the remainder of the description, the first and second liquid compartments will be called first and second water compartments.

The mixing system comprises a liquid pump 2 controlled by a control means of the mixing system and the inlet of which is connected to the outlet of the first water compartment of the reservoir 1. The control means is for example an electronic circuit supplied with electricity by means of a transformer comprised in the mixing system and connected to the home electrical system. For greater simplicity in the remainder of the description, this liquid pump 2 will be called water pump 2. The water pump 2 is suitable for guaranteeing the circulation of water from the first water compartment of the reservoir 1 toward a liquid intake pipe 3, which will be called water intake pipe 3 in the remainder of the description for greater simplicity. This intake pipe 3 guarantees the flow of liquid used to produce the cosmetic product in a mixing device of the mixing system, as will be explained later.

The mixing system further comprises a cylindrical moving plate 4, resting on a first support 26 secured to the casing of the mixing system and able to be controlled in rotation about a vertical axis 14*a* connected to a motor 14 secured to the casing of the mixing system, for example an electric motor. This moving plate 4 comprises at least two compartments 5, 6, preferably three compartments 5, 6, 10, formed in the body of the moving plate 4. Furthermore, the bottom wall of each compartment 5, 6, 10 comprises, in its center, a circular through orifice 5*a*, 6*a*, 10*a*, the function of which will be explained later.

The compartments 5, 6, 10 of the moving plate 4 are intended to house capsules 7, 8 containing various compounds for developing the final cosmetic product. The first compartment 5 of the moving plate is suitable for housing a capsule 7 containing a cosmetic texturizing agent. This texturizing agent is preferably a cosmetic oil, optionally doped with an emulsifier with a base of amphiphilic molecules. Alternatively, this texturizing agent is a polymer for cosmetic use, for example a polyoside such as xanthan gum or an acrylic acid polymer of the carbomer type. For greater simplicity in the remainder of the description, this cosmetic texturizing agent capsule 7 will be called cosmetic oil capsule 7.

The second compartment 6 of the moving plate is suitable for housing a capsule 8 containing a cosmetic active ingredient, i.e., a compound known for its cosmetic properties, for example antiwrinkle or hydrating properties. Furthermore, this capsule 8 may comprise a preservative product mixed with the cosmetic active ingredient. The third compartment 10 of the moving plate is in turn suitable for housing a capsule containing a cosmetic perfume, to scent the final cosmetic product.

Each capsule 7, 8 comprises a cylindrical wall 30, a bottom wall 31 with a central orifice 33 and a piston-forming wall 32 housed in the cylindrical wall 30. Thus, the cosmetic compound contained in the capsule 7, 8, whether it involves the cosmetic oil, the cosmetic active ingredient or the cosmetic perfume, is found in the cylindrical wall 30 between the bottom wall 31 and the piston-forming wall 32. Preferably, in order to avoid any contamination of the compound contained in the capsule, the central orifice 33 is sealed by a frangible membrane seal 35.

Furthermore, the moving plate 4 comprises a funnel-shaped compartment 13 able to be brought above the mixing device, to place the outlet of the water intake pipe 3 in fluid communication with the mixing device. Alternatively (not shown), the outlet of the water intake pipe 3 is positioned directly in fluid communication with the mixing device.

The mixing system further comprises means for pressurized expulsion 9 of the content of each capsule 7, 8 outside its corresponding compartment 5, 6, 10 in which it is housed. The expulsion means 9 comprise a motor 9*a*, preferably electric, secured to a second support 27, in turn secured to the casing of the mixing system and positioned opposite the moving plate 4 at a distance from the latter, such that the moving plate 4 is arranged between the first and second supports 26, 27. The expulsion means 9 also comprise a rod 9*b* that is translatable via this motor 9*a*. This rod 9*b* is thus able to exert pressure on the piston-forming wall 32 of each capsule 7, 8 housed in its corresponding compartment 5, 6, 10 of the moving plate 4, which causes the piercing of the frangible membrane seal 35 closing the central orifice 33 of the capsule 7, 8 and the forced flow outside the capsule of its content. The products contained in the capsules 7, 8 will successively flow through the respective through orifices 5*a*, 6*a*, 10*a* of the compartments 5, 6, 10 of the open plate 4, as will be seen later in the description.

Preferably, in order to optimize the expulsion of the content of the capsule 7, 8, the bottom wall 31 of the capsule and the surface of the piston-forming wall 32 situated opposite the bottom wall 31 have substantially frustoconical complementary shapes. Furthermore, the bottom wall 31 of the capsule may comprise a tubular ring 34 with a circular section protruding coaxially to the orifice 33 of the bottom wall 31 of the capsule. Thus, when the capsule 7, 8 is housed in its compartment 5, 6, 10 of the moving plate 4, the tubular ring 34 is housed in the circular through orifice 5*a*, 6*a*, 10*a* of the corresponding compartment 5, 6, 10. In this way, the content expelled from the corresponding capsule does not come into contact with the cylindrical surface delimiting the through orifice 5*a*, 6*a*, 10*a* of the corresponding compartment 5, 6, 10. In the presence of the tubular ring 34, the frangible membrane seal is glued on the free end of the ring 34 so as to seal the central orifice 33.

The mixing device includes a container 11 positioned below the moving plate 4 controlled to successively position, above the container 11, the outlet 5*a*, 6*a*, 10*a* of each of the compartments 5, 6, 10 and the outlet 13*a* of the funnel-shaped compartment 13 of the moving plate 4, so that the container 11 can successively receive the water, the cosmetic oil, the active ingredient and, if applicable, the cosmetic perfume expelled from their respective compartments 13, 5, 6, 10. The mixing device also comprises a mixing member 12 housed in the container 11 and able to create the cosmetic product in this container 11 from a mixture of water, cosmetic oil and cosmetic active ingredient, and if applicable cosmetic perfume.

According to one preferred embodiment shown in the figures, the container 11 of the mixing device is a removable cylindrical tube closed by a bottom wall to allow the storage of the produced cosmetic product. The mixing member 12 in this embodiment comprises a piston 12*a* forming the bottom wall of the container 11 and a plurality of radial fins 22*a* secured to the piston 12*a* and protruding from the upper face of the piston 12*a*. The piston 12*a* is able to be rotated with the fins 22*a*, when the removable container 11 is mounted on the mixing system, by a toothed crown 23 mounted in a support base 25 of the container 11 coaxially to the latter. The axial teeth 24*a* of the crown 23 are all situated on a same side of the crown 23 and are able to be coupled to the piston 12*a*. Furthermore, the toothed crown 23 comprises an axle portion 24*b* protruding perpendicularly to the crown 23 and also intended to be coupled by clipping to the piston 12*a* in order to facilitate the centering of the piston 12*a* on the toothed crown 23 and to prevent any translational movement of the piston 12*a* in the container 11 when the piston 12*a* is rotated. The crown 23 can in turn be rotated by an electric motor secured to the base 25 and controlled by the control means of the mixing system. Furthermore, the support base 25 is translatable to make it possible to bring the opening of the container 11 further from or closer to the moving plate 4.

Alternatively, the mixing member 12 forming the bottom wall of the container is made in two parts. The first part is the piston 12*b* in itself, which is the bottom wall of the container 11, the piston 12*b* in this alternative being immobile in rotation. The second part comprises a rod 39 axially passing through the piston 12*b* at its center, the opposite ends of this rod 39 respectively comprising a mixing disc 28 comprising fins 22*b* circumferentially secured to this mixing disc 28, and the disc 29 for driving the rotation of the rod 39, the discs 28, 29 being arranged on either side of the body of the piston 12*b*. The rotational driving disc 29 is able to be rotated with the rod 39 and the mixing disc 28 with fins 22*b*, when the removable container 11 is mounted on the mixing system, by a toothed crown 37 mounted in the support base 25 of the container 11 coaxially to the latter. The teeth 37*a* of the crown 37 extend radially on a face of the latter and are able to be coupled by clipping to the rotational driving disc 29, in oblong orifices 29*a* provided to that end. The crown 37 can in turn be rotated by an electric motor of the mixing system controlled by the control means of the mixing system. The length of the rod 39 is greater than the thickness of the piston 12*b*. Thus, when the driving disc 29 is clipped on the crown 37, the mixing disc 28 is moved away from the upper surface of the piston 12*b* in order on the one hand to prevent any rubbing of this mixing disc 28 on the upper surface of the piston 12*b*, and on the other hand to improve the effectiveness of the mixing in the container 11, the mixture being suctioned through the mixing disc 28. Conversely, when the user removes the container 11 from the base 25 of the mixing system, the teeth 37*a* of the wheel 37 first retain the rotational driving disc 29, which causes the movement of the rod 39 relative to the piston 12*b*, such that the disc 28 with fins 22*b* comes into contact with the corresponding surface of the piston 12*b* just before the unclipping of the rotational driving disc 29. Preferably, the mixing disc 28 with fins 22*b* can be housed in a housing made in the wall of the piston 12*b* at the upper surface thereof.

Furthermore, irrespective of the alternative embodiment of the piston, the bottom of the container 11 includes notches 11*a* for embedding in corresponding stops on the base 25, which prevents the container 11 from rotating during the rotation of the piston 12*a* or the mixing disc 28, so that only the latter or the piston 12*a* rotate. Lastly, the shape and the position of the fins 22*a* of the piston 12*a* or alternatively of the fins 22*b* of the mixing disc 28 make it possible, preferably, to produce an emulsion from the oil phase coming from the oil capsule 7 and the water coming from the corresponding water compartment. In the remainder of the description, reference will preferably made to an emulsion, but any other type of cosmetic product that is easier to produce, for example a gel or a lotion, can be made with the mixing system.

The cosmetic oil contained in the corresponding capsule 7 is in the solid state. It is therefore necessary, in order to produce the mixture of water and cosmetic oil, to melt this oil and bring it to a temperature of around 75° C. A heating resistance 19 is incorporated into the compartment 5 of the moving plate 4 of the cosmetic oil capsule 7. This heating resistance 19 is in the form of a tubular ring and is provided to surround the cylindrical wall of the cosmetic oil capsule. Preferably, this electrical resistance 19 comprises a resilient material such that the resistance 19 exerts pressure on the cylindrical wall 30 of the capsule 7 when the latter is housed in its corresponding compartment 5. Furthermore, as shown in particular in FIG. 1, a heating means 20 for the water controlled by the control means of the mixing system is incorporated into the mixing system and connected to the water pump 2 of the mixing system and the water intake pipe 3. This heating means 20 is preferably an internal electrical resistance heating block.

It is preferable first to produce, in the container 11, an emulsion of hot water and cosmetic oil, then to cool this emulsion. To that end, the mixing system comprises a hollow cooling water circulation block 17 partially surrounding the container 11. The water inlet and outlet of this block 17 are connected to the second water compartment of the reservoir 1 by another pump 18 to guarantee the cooling of the emulsion in the container 11. The quantity of emulsion to be cooled being negligible compared to the quantity of water in the compartment 28, the circulation of the cooling water in a closed loop is sufficient without risking this water heating up too much. At the end of this cooling, the active ingredient and the cosmetic perfume are added into the emulsion to form the cosmetic product, by successive forced expulsion of the content of these capsules through orifices of the corresponding compartments of the moving plate in the container.

The mixing system comprises a solenoid valve 15 controlled by the control means and arranged between the water pump 2 and the internal electrical resistance heating block 20 in order to control the circulation of water in the container 11. To make the connections possible, the inlet and the outlet of the solenoid valve are respectively connected to the outlet of the water pump 2 of the mixing system and to the inlet of the heating block 20 by means of flexible or rigid lines 16. It is also possible to place the solenoid valve elsewhere in the system, in particular between the heating block 20 and the inlet of the water intake pipe. Furthermore, all of the connections are done by means of such flexible or rigid lines 16, for example made from polyvinyl chloride.

The mixing system also comprises a flowmeter 21 connected to the outlet of the water pump 2 of the mixing system. As will be seen hereinafter, the data from the flowmeter 21 are used by the control means to deliver the necessary and sufficient volume of water through the water intake pipe 3 to produce the cosmetic product.

A method for manufacturing a cosmetic product using a mixing system according to the disclosure will now be described.

First, the user places the base 25 in the low position, if it is not already there, and clips the mixing member 12 on the teeth of the toothed crown 23, 37; next he clips the container 11 above the piston 12*a*, 12*b*, the piston 12*a*, 12*b* then being inside the container 11. He can then mount the base 25 in the high position, the top of the bottle then being just below the moving plate 4. It is also possible to clip the container 11 while the base 25 is in the high position, if the height of the container 11 allows it. The user then powers on the mixing system and initiates, for example by pressing a button provided to that end, a program for producing cosmetic products stored in a memory space of the control means of the mixing system, this program being executed by the control means to allow the implementation of the method for producing the cosmetic product.

During the first step of the method, the control means steers the rotation of the moving plate 4 so that the compartment 5 of the moving plate 4, intended to receive the cosmetic oil capsule 7, is accessible to the user so that the latter can house a cosmetic oil capsule 7 therein. Indeed, the second support 27 includes a notched opening 38 in the wall of the second support 27 from the edge of this wall and allowing the successive access to each compartment 5, 6, 10 of the moving plate 4. After a determined time, or alternatively when detection means 40 of the mixing system secured to the second support 27 detect the presence of the cosmetic oil capsule 7, the control means steers the rotation of the moving plate 4 so that the compartment 6 of the moving plate 4, intended to receive the cosmetic active ingredient capsule 8, is opposite the opening 38 of the second support 27 in order to be accessible to the user so that the latter can house a cosmetic active ingredient capsule 8 therein. If applicable, after detection of this capsule 8 or after a determined length of time has elapsed, the control means steer the rotation of the moving plate 4 so that the compartment 10 of the moving plate 4, intended to receive the cosmetic perfume capsule, is accessible to the user so that the latter can house a cosmetic perfume capsule therein. Alternatively, it is the user who can control the rotation of the moving plate 4, for example by pressing on a button of the mixing system provided to that end, in order successively to introduce the capsules 7, 8 into their corresponding compartment 5, 6, 10.

Preferably, the cosmetic capsules 7, 8 comprise a circular frangible membrane 36 sealing the opening of the cylindrical wall 30 of the capsule situated opposite the orifice 33 of the bottom wall 31 of the capsule 7, 8. Each frangible membrane 36 can comprise a bar code or any other identification means able to be read by the detection means 40 of the mixing system, in order in particular to determine the type of oil, the type of active ingredient or the type of cosmetic perfume. In order to facilitate the adhesion of this frangible membrane 36, the cylindrical wall 30 of the capsule 7, 8 may comprise, at its opening opposite the orifice 33 of the bottom wall 31, a flange on which the membrane 36 is adhered.

After reading the barcode printed on the frangible membrane 36 of the cosmetic oil capsule 7 and during the second step of the method, the mixing system commands the supply of energy of the heating means 19 arranged in the compartment 5 in which the cosmetic oil capsule 7 is housed, so as to melt the cosmetic oil. In parallel, the control means steers the supply of power to the electrical resistance of the heating block 20 in order to subsequently heat the water that will be brought into the block 20 to a temperature of about 90° C. The barcode of the capsule 7, 8 also allows the mixing system to calculate the necessary volume of water that will be included in the production of the final product in the container 11.

Alternatively, if the detection means detects that the capsule 7 comprises a texturizing agent that does not require heating, then neither the water nor the capsule 7 are heated, since the control means will not supply energy to the electrical resistance of the heating block 20 and the heating means 19 of the capsule 7. Thus, the second step of the method is avoided.

The control means steers, during the third step of the method, the rotation of the moving plate 4 such that the outlet 13*a* of the funnel-shaped compartment 13 is respectively opposite the container 11 and the outlet of the water intake pipe 3. The control means next steers the opening of the solenoid valve 15 and starts up the water pump 2 such that a determined volume of hot water calculated from data from the flowmeter 21 passes through the heating block 20 to be heated to 90° C. Once the temperature of the water in the heating block reaches 90° C., the water flows into the container 11, via the water intake pipe 3. Once this volume of hot water has flowed into the container 11, the control means steers the closing of the solenoid valve 15 and the water pump 2, and stops the supply of energy to the resistance of the water heating block 20.

In the alternative where the capsules 7, 8 do not comprise barcodes, it is the user who chooses, via an interface means comprised in the mixing system, on the one hand whether the heating of the texturizing agent capsule 7 and water is necessary, and on the other hand the volume of water needed to produce the cosmetic product. For example, the mixing system may comprise a means for selecting a so-called "hot" production method, a means for selecting a so-called "cold" production method, and a cursor making it possible to adjust the necessary volume of water.

During the fourth step of the method, the control means steers the rotation of the moving plate 4 such that the outlet 5*a* of the compartment 5 in which the oil capsule 7 is housed is opposite the container 11, and the piston-forming wall 32 of the capsule 7, or more specifically the frangible membrane 36 covering the opening of the cylindrical wall 30 of the capsule 7, is opposite the moving rod 9*b* of the pressurized expulsion means 9. Then, the motor 9*a* of the pressurized expulsion means 9 is turned on by the control means in order to move the moving rod 9*b* vertically toward the piston-forming wall 32 of the capsule 7. The moving rod 9*b* then tears the frangible membrane 36, then bears against the piston 32, exerting pressure on the latter to cause the piercing of the frangible membrane seal 35 in the bottom wall 31 and the forced flow of the cosmetic oil from the capsule 7 into the container 11. Once the piston-forming wall 32 touches the bottom wall 31 of the capsule 7, the control means steers the rising of the moving rod 9*b* via the corresponding motor 9*a*. Concomitantly, or preferably just after the expulsion of the cosmetic oil from the corresponding capsule 7, the control means powers on the motor connected to the toothed wheel 23, 37 in order to rotate the latter and consequently to rotate the piston 12*a* and/or the fins 22*a*, 22*b* of the mixing device 12 in order to produce the emulsion from the melted cosmetic oil and hot water contained in the container 11.

After a given time, the water pump 18 connected to the second water compartment of the reservoir 1 and the cooling water circulation block 17 is turned on for a given time to cool the emulsion in the container 11 during the fifth step of the method.

Once the cooling time has elapsed and the emulsion has reached a temperature of about 40° C., the sixth step of the method is carried out: the control means optionally stops the water pump 18 connected to the cooling water circulation block 17 and commands the rotation of the moving plate 4 such that the outlet 6*a* of the compartment 6 in which the active ingredient capsule 8 is housed is opposite the container 11, and the piston-forming wall 32 of the capsule 8, or more specifically the frangible membrane 36 covering the opening of the cylindrical wall 30 of the capsule 8, is opposite the moving rod 9*b* of the pressurized expulsion means 9. Then, the motor 9*a* of the pressurized expulsion means 9 is turned on by the control means in order to move the moving rod 9*b* vertically toward the piston-forming wall 32 of the capsule 8. The moving rod 9*b* then tears the frangible membrane 36, then bears against the piston 32, exerting pressure on the latter to cause the piercing of the frangible membrane 35 of the bottom wall 31 and the forced flow of the cosmetic active ingredient from the capsule 8 into the container 11. Once the piston-forming wall 32 touches the bottom wall 31 of the capsule 8, the control means steers the rising of the moving rod 9*b* via the corresponding motor 9*a*. The electric motor then rotates the piston 12*a* and the fins 22*a* or alternatively the mixing disc 28 and the fins 23*b* of the mixing member 12 remains supplied with power, allowing the incorporation of the cosmetic active ingredient into the emulsion.

Optionally, if the user initially chose an advanced program of the mixing system, the rotation of the moving plate is steered by the corresponding motor so as to make the compartment 6 intended to house an active ingredient capsule 8 accessible to the user. The latter can then remove the used active ingredient capsule 8 and install a new one. The sixth step is then repeated, such that the final cosmetic product comprises two cosmetic active ingredients with different and/or complementary virtues. Alternatively, the sixth step is repeated after the seventh step that will be described hereinafter, i.e., after introducing cosmetic perfume into the container 11.

During the seventh step of the method, the control means steers the rotation of the moving plate 4 such that the outlet of the compartment 11 in which the perfume capsule is housed is opposite the container 11, and the piston-forming wall 32 of the capsule, or more specifically the frangible membrane 36 covering the opening of the cylindrical wall 30 of the capsule, is opposite the moving rod 9*b* of the pressurized expulsion means 9. Then, the motor of the pressurized expulsion means 9 is turned on by the control means in order to move the moving rod 9*b* vertically toward the piston-forming wall 32 of the capsule. The moving rod 9*b* then tears the frangible membrane 36, then bears against the piston 32, exerting pressure on the latter to cause the piercing of the frangible membrane 35 of the bottom wall 31 and the forced flow of the cosmetic perfume from the capsule into the container 11. Once the piston-forming wall 32 touches the bottom wall 31 of the capsule, the control means controls the rising of the moving rod 9*b* via the corresponding motor 9*a*. The electric motor that rotates the piston 12*a* and the fins 22*a* or alternatively the mixing disc 28 and the fins 23*b* of the mixing member 12 remains supplied with power, allowing the incorporation of the cosmetic perfume into the emulsion.

Alternatively, if no perfume capsule is detected in the corresponding compartment 10, the seventh step of the method does not take place.

During the eighth step of the method, the control means powers off the motor intended to drive the toothed crown 23, 37, which stops the piston 12*a* and/or the fins 22*a*, 22*b* of the mixing member 12, when the cosmetic product reaches a temperature below 35° C., or even 30° C., or after a determined length of time. The user can then recover the container 11 with the piston 12*a*, 12*b* that serves as bottom wall. A lid can then be placed on the opening of the container 11 to shelter the cosmetic product from air and preserve it. More specifically, the user lowers the base 25, clips the lid on the container 11 and unclips the container 11 from the toothed crown 23, 37.

Advantageously, the user can use the container 11 removed from the mixing system and filled with the cosmetic product made using the mixing system as bottle for storing and dispensing the cosmetic product. To that end, a head closes the opening of the container 11 opposite the piston 12*a*, 12*b*, said head including a pump for dispensing the cosmetic product provided with a trigger able to be actuated manually. Furthermore, the head comprises a rigid tube plunged into the cosmetic product. This head with dispensing pump and trigger is well known by one skilled in the art, and is for example found on certain bottles of cosmetic creams. Thus, when the user presses on the trigger, a volume of cosmetic product is dispensed at the outlet of the head. When the user releases the trigger, a vacuum is created in the container 11, which causes the piston 12*a*, 12*b* to move in the container 11 toward the head, to offset the dispensed volume of cosmetic product. The free end of the rigid tube secured to the head will therefore always be submerged in the cosmetic product.

The configuration of the mixing system of the disclosure is not limited to the embodiment previously described and shown in the figures. It has been provided solely as a non-limiting example. Multiple changes can be made without going beyond the scope of the disclosure. In particular, the container 11 of the mixing device may not be removable and the mixing member 12 then comprises a helix mounted at the bottom of the container 11 on an axle coaxial to the latter. This axle is mounted in the bottom wall of the container 11 and can be driven by an electric motor mounted in the mixing system and controlled by the control means of the mixing system. Furthermore, in order to recover the cosmetic product produced in a storage bottle, the container 11 comprises a timed valve in its bottom wall to allow the flow of the emulsion by gravity. Alternatively, this valve can be actuated manually, and the cosmetic product flows by gravity if the bottle of the latter is relatively fluid, or by overpressure applied in the container 11 by an appropriate hydraulic or pneumatic system if the product is too thick or viscous. Lastly, it is possible to conceive a cooling block 17 without water circulation, this block 17, comprising a cold accumulator liquid, being placed in the freezer before use of the mixer system. In this case, the liquid reservoir 1 has a single compartment and the second water pump 18 is not necessary. Lastly, it is possible to conceive of replacing the heating block 20 for the water with a heating means of the electrical resistance type housed in the funnel-shaped compartment 13, so as to heat the water flowing in the funnel-shaped compartment 13 directly in the latter.

The invention claimed is:

1. A mixing system for manufacturing a cosmetic product comprising:

a liquid reservoir;

a liquid pump connected between an outlet of the liquid reservoir and an inlet of a liquid intake pipe;

two capsules, one of which contains a cosmetic texturizing agent and the other of which contains a cosmetic active ingredient, each capsule comprising a cylindrical wall, a bottom wall with a central orifice, and a piston-forming wall housed in the cylindrical wall, the cosmetic texturizing agent or active ingredient contained in the respective capsule being found in the cylindrical wall between the bottom wall and the piston-forming wall;

a moving plate controlled in rotation about a vertical axis and comprising a first and a second capsule compartments respectively receiving the first and the second capsules;

a pressure expeller, expelling a content of each capsule outside its corresponding capsule compartment in which it is housed, by exerting pressure on the piston-forming wall of the corresponding capsule;

a heater arranged in the first capsule compartment receiving the first capsule, said heater surrounding the first capsule housed in the corresponding capsule compartment melting the content contained in the capsule before the pressurized expulsion of the content in the container by the pressure expeller a mixing device comprising a container arranged below the controlled moving plate with sequentially positioning, above the container, the first capsule compartment containing the first capsule and the second capsule compartment containing the second capsule and receiving contents of the first and second capsules expelled from their respective capsule compartments, the container being in fluid communication with an outlet of the liquid intake pipe with introduction of liquid into the container before expulsion of the content of the second capsule into the container, a hollow cooling liquid circulation block at least partially surrounding the container, and whereof liquid inlet and outlet of said cooling liquid block are connected to the liquid reservoir by another pump and cool a mixture contained in the container, before expulsion of the second capsule into the container, and a mixing member housed in the container and creating, in said container, the cosmetic product from a mixture of liquid, and contents of the first and second capsules contained in the container;

wherein the mixing member of the mixing device produces an emulsion from liquid coming from the reservoir, and melted cosmetic texturizing agent coming from the first capsule compartments of the moving plate, before cooling of the mixture contained in the container by the hollow cooling liquid circulation block, and produces the cosmetic product from the emulsion and the cosmetic active ingredient.

2. The mixing system according to claim 1, wherein the mixing member is mounted at a bottom of the container on an axle coaxial to the latter, passing through a bottom wall of the container and being driven by a motor, mounted in the mixing system.

3. The mixing system according to claim 1, wherein the container is a removable cylindrical tube closed by a bottom wall allowing the storage of the cosmetic product for subsequent use thereof and arranged below the first and second capsule compartments of the moving plate.

4. The mixing system according to claim 3, wherein the mixing member comprises a piston forming the bottom wall of the container and a plurality of radial fins secured to the piston and protruding from the upper face of the piston that is rotated with the fins, when the removable container is mounted on the mixing system, by a toothed crown mounted in a support base of the container coaxially to the latter and the axial teeth of which situated on a same side are coupled to the piston, said toothed crown being rotated by an electric motor of the mixing system.

5. The mixing system according to claim 1 wherein the moving plate includes a third capsule compartment brought above the container and suitable for including a third capsule.

6. The mixing system according to claim 1 wherein the moving plate comprises a funnel-shaped compartment brought above the container with placing an outlet of the liquid intake pipe and the container in fluid communication.

7. The mixing system according to claim 6, further comprising a solenoid valve arranged in the liquid intake pipe and controlling the circulation of liquid in the container.

8. The mixing system according to claim 7, further comprising a flowmeter connected to the liquid intake pipe of the mixing system and in that it comprises a controller opening, when the moving plate is positioned such that the funnel-shaped compartment places an outlet of the liquid intake pipe and the container in fluid communication, the solenoid valve and guaranteeing the circulation for a given time interval of a determined volume of liquid in the container and calculated from data from the flowmeter.

9. The mixing system according to claim 1 wherein the central orifice is closed off by a frangible membrane seal and the pressure expeller comprises a rod translatable via a motor mounted in the mixing system, exerting pressure on the piston-forming wall of each of the first and second capsules housed in its capsule compartment of the moving plate causing piercing of the membrane seal of the bottom wall of the capsule and forced flow outside the capsule of its contents into the container located below an outlet of the corresponding capsule compartment.

10. The mixing system according to claim 1 wherein a rotation of the moving plate is controlled via a motor mounted in the mixing system, the pressure expeller causing successively forced flow of the content of each of the first and second capsules housed in its corresponding capsule compartment of the moving plate.

11. The mixing system according to claim 1, wherein the liquid reservoir comprises two reservoir compartments separated by an inner wall, a first of the reservoir compartments being connected to the liquid pump of the mixing system and a second reservoir compartment being connected to the cooling block via another pump.

12. The mixing system according to claim 1, wherein the container is in fluid communication with the outlet of the liquid intake pipe through a rotation of the moving plate after expulsion of the cosmetic texturizing agent from the corresponding capsule.

13. The mixing system according to claim 1, wherein the container is in fluid communication with the outlet of the liquid intake pipe in a direct manner or through a liquid compartment of the moving plate distinct and angularly separated from the compartment of the first capsule and from the compartment of the second capsule.

* * * * *